US005821693A

United States Patent [19]

White et al.

[11] Patent Number: 5,821,693

[45] Date of Patent: Oct. 13, 1998

[54] ELECTRON BEAM TUBES HAVING A UNITARY ENVELOPE HAVING STEPPED INNER SURFACE

[75] Inventors: Graham Douglas White, Halstead; David Mark Wilcox, Chelmsford, both of United Kingdom

[73] Assignee: EEV Limited, Essex, United Kingdom

[21] Appl. No.: 510,739

[22] Filed: Aug. 3, 1995

[30] Foreign Application Priority Data

Aug. 3, 1994 [GB] United Kingdom ..... 9415713

[51] Int. Cl.[6] ..... H01J 25/10; H01J 23/34

[52] U.S. Cl. ..... 315/5.39; 315/5.43; 315/5.51; 315/5.35

[58] Field of Search ..... 315/5.39, 5.43, 315/5.31, 5.35, 5.46, 5.47, 5.48; 333/227, 230

[56] References Cited

U.S. PATENT DOCUMENTS

| | | | |
|---|---|---|---|
| 2,543,011 | 2/1951 | Gibson | 315/5.48 X |
| 2,859,374 | 11/1958 | Birdsall et al. | 315/5.39 X |
| 3,231,779 | 1/1966 | White | 315/5 X |
| 3,297,905 | 1/1967 | Fiedor et al. | 315/3.5 |
| 3,502,934 | 3/1970 | Friedlander et al. | 315/5.39 |
| 3,775,635 | 11/1973 | Faillon et al. | 315/5.39 X |
| 3,940,655 | 2/1976 | Palluel et al. | 315/5.39 X |
| 4,004,181 | 1/1977 | Kervizic et al. | 315/5.43 X |
| 4,209,755 | 6/1980 | Busacca et al. | 331/83 |
| 4,661,784 | 4/1987 | Kelley et al. | 331/83 |
| 4,733,131 | 3/1988 | Tran et al. | 315/4 X |
| 4,800,322 | 1/1989 | Symons | 315/5.39 |

FOREIGN PATENT DOCUMENTS

| | | | |
|---|---|---|---|
| 181214 | 5/1986 | European Pat. Off. . | |
| 2024085 | 8/1970 | France . | |
| 25148 | 2/1984 | Japan | 315/5.39 |
| 7-105860 | 4/1995 | Japan . | |
| 959192 | 5/1964 | United Kingdom . | |
| 981742 | 1/1965 | United Kingdom . | |
| 1054461 | 1/1967 | United Kingdom . | |
| 1067355 | 5/1967 | United Kingdom . | |
| 1 289 179 | 9/1972 | United Kingdom . | |
| 1366741 | 9/1974 | United Kingdom . | |
| 2 043 333 | 10/1980 | United Kingdom . | |
| 2164488 | 3/1986 | United Kingdom . | |
| 2778495 | 11/1994 | United Kingdom | 315/5 |
| 2 280 542 | 2/1995 | United Kingdom . | |

*Primary Examiner*—Benny T. Lee
*Attorney, Agent, or Firm*—Spencer & Frank

[57] ABSTRACT

An electron beam tube includes a unitary metal cylinder and a plurality of transverse walls located within it which define resonant cavities. As the cylinder is in one piece vacuum joints are only required at the ends of the structure. Drift spaces between the resonant cavities are enclosed within drift tubes which join two adjacent transverse walls. The inner diameter of the tube is stepped to facilitate assembly and accuracy of the structure. In use, an electron beam is generated and interacts with applied r.f. energy to produce amplification of an applied r.f. signal.

16 Claims, 2 Drawing Sheets

ELECTRON BEAM TUBES HAVING A UNITARY ENVELOPE HAVING STEPPED INNER SURFACE

FIELD OF THE INVENTION

This invention relates to electron beam tubes and more particularly, but not exclusively, to klystrons.

BACKGROUND TO THE INVENTION

A klystron is an amplifying device in which an electron beam is velocity modulated by a high frequency signal which is applied to an input resonant cavity, the amplified output signal being coupled from another resonant cavity. FIG. 1 schematically shows a conventional klystron which includes an electron gun 1 for generating a beam of electrons directed along the longitudinal axis X—X. The high frequency signal to be amplified is coupled into the input cavity 2 via a coupling loop 3 and produces velocity modulation of electrons of the beam travelling through the cavity 2. The cavity 2 is followed by a drift tube 4 and, typically, several intermediate cavities, two of which 5 and 6 are illustrated, where further bunching of the electrons occurs. The output cavity 7 includes a coupling loop 8 via which the amplified r.f. signal is taken from the device. The electrons of the beam are incident on a collector 9 following the output cavity 7. The electron beam is focused by permanent magnets or electromagnets around the outside of the r.f. interaction structure to counteract the divergence of the beam due to space charge and prevent the beam from hitting the walls.

The present invention arose from considering the manufacture of a low cost klystron but it is also applicable to other types of electron beam tubes employing resonant cavities.

SUMMARY OF THE INVENTION

According to the invention, there is provided an electron beam tube comprising: a plurality of resonant cavities having drift spaces between them; and a gas-tight envelope comprising a unitary cylinder the inner surface of which defines the outer extent of the resonant cavities.

By the term "unitary" it is meant that the cylinder is formed as one piece without vacuum joints and not as separate sections joined together. This term also includes a cylinder which consists of an outer part of one material and an inner part or liner of another material. The cylinder is preferably of circular cross-section because of its symmetry but it could be of other cross-sectional shapes, for example, it could have an elliptical or square cross-section.

As the envelope defines part of the plurality of resonant cavities fewer vacuum joints are required than for a conventional design. In a typical example, only two such joints are required compared to fifty or more in a conventional tube of comparable size and operating parameters. Although the joints at each end of the cylinder must be vacuum tight, joints between the cylinder and other surfaces defining the resonant cavities need only be electrically good. A tube in accordance with the invention may therefore be more easily and quickly fabricated than a conventional device. The procedure for testing vacuum integrity and making repairs is also simplified. Namely, if a leaking seal is detected, there are relatively few seals to inspect. Fewer components are required in a tube, reducing the number of assembly steps required in addition to reducing the number of vacuum-tight brazes which are needed.

Another advantage is that a relatively long electron beam tube in accordance with the invention tends to be more robust than a similar conventional device. A conventional device would be more prone to bending, and has an increased tendency for cracks to occur, with consequent loss of vacuum integrity, during handling, transportation and installation.

The components of the tube may be manufactured and assembled with high precision within the cylinder. This is advantageous for any electron beam tube but is particularly useful for multiple beam devices. For example, in a multiple beam klystron, a plurality of separate cathodes are distributed on the circumference of a circle and arranged to generate parallel electron beams which pass through individual drift tubes and through common cavities. Alignment is particularly critical and may be more easily obtained by using the present invention instead of a conventional construction.

Preferably, means are provided for flowing a coolant fluid, which may be for example air or water, over the outer surface of the cylinder. As this surface can be made smooth, unlike a conventional klystron say, it allows uniform cooling over its surface, avoiding air pockets which could lead to localized heat spots.

In a preferred embodiment of the invention, the cylinder is of copper because of its high thermal conductivity although other electrically conductive materials could be used. In one embodiment, the cylinder includes two or more materials, the inner surface being electrically conductive. Providing that the inner material is sufficiently thick to allow conduction through it, this could consist of a metallisation layer on an electrically insulating outer part. Such metallisation could be provided on selected regions only of the inner surface of the cylinder, where the resonant cavities are located.

Advantageously, the inner surface of the cylinder is stepped and components located within the cylinder are mounted on the steps. The interior configuration of the cylinder can be machined to high tolerances with modem computer controlled machining techniques. The accurate interior configuration in turn leads to accurate location of components within the cylinder and this is achievable with relative ease compared to the jigging required for conventional designs.

Advantageously, magnetic focusing means is provided around the outside of the cylinder. The focusing means may be electromagnetic means or use permanent magnetic material. For example, a coil may be wound around the outside of the cylinder. This is an expensive component of an electron beam tube which in conventional designs would not be salvaged from old tubes when they are scrapped. However, in a tube in accordance with the invention, the electromagnetic coil means could be recovered without damaging it. Electromagnetic coils may be wound directly on the outer surface of the cylinder itself or kept on a separate frame about it.

Advantageously, the drift spaces between resonant cavities are enclosed by drift tubes. In some designs these could be omitted but use of drift tubes ensures that resonances arising from volumes between adjacent resonant cavities do not interfere with operation of the tube.

Preferably, one or more of the resonant cavities includes a wall arranged transversely to the longitudinal axis of the cylinder and having a central aperture through which in use an electron beam is directed. Where drift tubes are used around the drift spaces, advantageously, these may be joined with two transverse walls defining respective adjacent resonant cavities. This integration reduces the number of components to be fitted in the cylinder.

It may be preferred that the cylinder defines the outer extent of all of the resonant cavities included within the electron beam tube. However, the end cavities, say, could be separately housed but such an arrangement increases the number of vacuum joints required and reduces the advantages obtainable from use of the invention.

In another advantageous arrangement, at least one of the cavities is resonant at a higher frequency than the others. This may be a second harmonic cavity for example. The cavity volume may be reduced by the transverse walls being spaced a smaller distance apart than the remaining cavities but it is preferred that the outer diameter of the cavity is smaller. This enables the optimum cavity height to diameter ratio to be preserved. This may be achieved by suitably configuring the interior surface of the cylinder so that the internal diameter is reduced where the second harmonic cavity is located. In an alternative embodiment, a cylindrical wall of the required diameter is positioned inside and coaxial with the cylinder.

BRIEF DESCRIPTION OF THE DRAWINGS

Some ways in which the invention may be performed is now described by way of example with reference to the accompanying drawings in which similar reference characters refer to similar reference parts, and in which.

DESCRIPTION OF PREFERRED EMBODIMENTS

Figure 1:
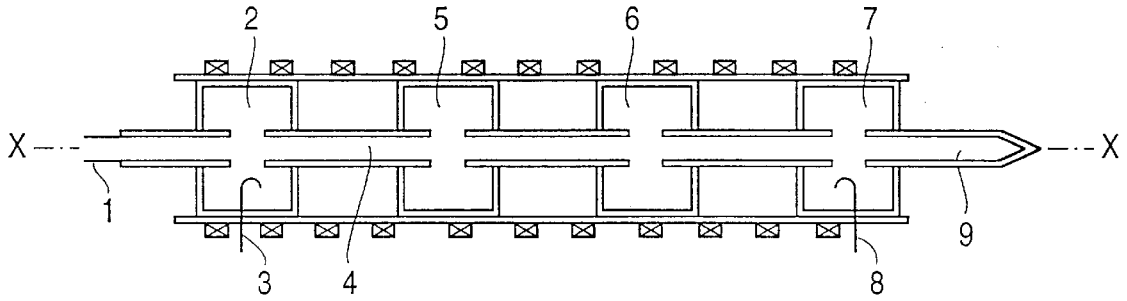
FIG. 1 PRIOR ART
FIG. 1 schematically illustrates a previously known klystron.
Figure 2:
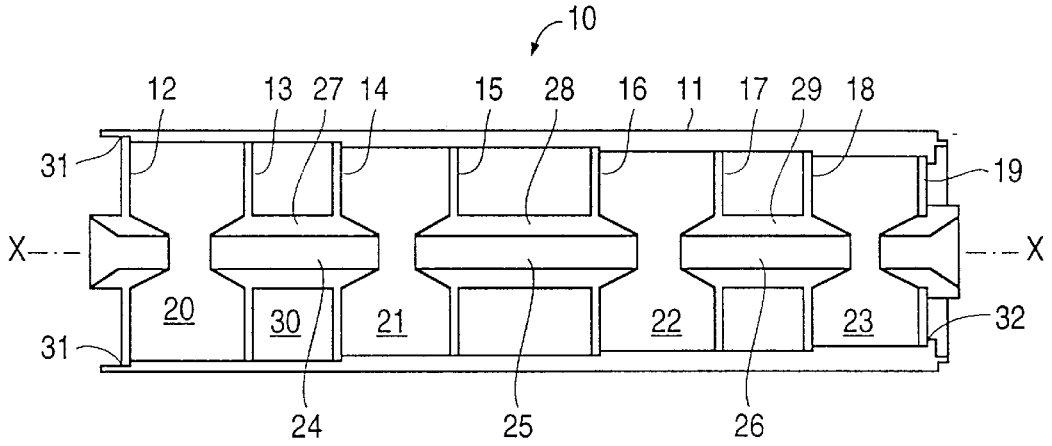
FIG. 2 schematically illustrates a resonant cavity structure.

With reference to FIG. 2, an r.f. cavity structure 10 used in a klystron includes a copper cylinder 11 which forms part of the vacuum envelope and is of circular cross-section. The outer surface is smooth and its inner diameter reduces in steps from the left hand side, as shown, to the right hand side. A plurality of walls 12, 13, 14, 15, 16, 17, 18, and 19 are located inside the cylinder 11 and are arranged transversely to the longitudinal axis X—X along which an electron beam is directed during use. The transverse walls define resonant cavities 20, 21, 22 and 23 and have central apertures through which the electron beam is arranged to pass. The regions 24, 25 and 26 between the resonant cavities are drift spaces and are surrounded by drift tubes 27, 28 and 29 respectively.

The three drift tubes 27, 28 and 29 are each formed as integral components with some of the transverse walls. Thus, drift tube 27 forms part of a single component which also includes walls 13 and 14. Similarly drift tube 28 forms a component with walls 15 and 16, and drift tube 29 is combined with walls 17 and 18. The first and last mentioned components including drift tubes 27 and 29 respectively are identical in length and configuration except that the right hand component as shown has a smaller outer diameter to enable it to be located at the smaller internal diameter end of the cylinder 11.

The stepped bore of the cylinder 11 facilitates assembly and ensures positional accuracy. As the inner surface of the cylinder 11 and the transverse walls can be accurately machined and matched, this ensures that concentricity is maintained.

The resonant cavity 20 is defined by the transverse walls 12 and 13 and by the inner surface of the cylinder 11. The annular region 30 bound by the walls 13 and 14 and drift tube 27 does not contribute to the operation of the device and is effectively "dead" space. Apertures (not shown) are included in the walls 13 and 14 to enable the region 30 to be evacuated once the structure is assembled and similarly the other transverse walls also include such apertures.

The joints made between the walls 13 to 18 and the inner surface of the cylinder 11 are not required to be vacuum tight, these only being required at locations 31 and 32 at the ends of the cylinder 11.

Figure 3:
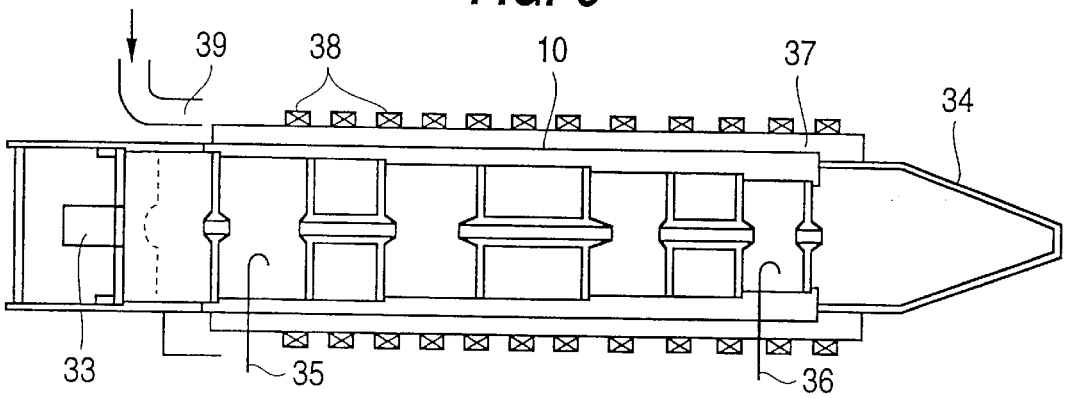
FIG. 3 schematically shows a klystron in accordance with the invention using the structure of FIG. 2.

FIG. 3 illustrates the structure of FIG. 2 included in a klystron having an electron gun assembly 33 arranged at the left hand end as shown and a collector 34 with coupling loops 35 and 36. A frame 37 carries electromagnetic coils 38 for focusing and air is directed over the outer surface of the cylinder 11 via duct 39.

In another embodiment of the invention, the cylinder 11 comprises an outer region of one material and an inner lining of another material. For example, the cylinder may have an outer tube of ceramic material and an inner metallisation layer sufficiently thick for good current conduction.

Figure 4:
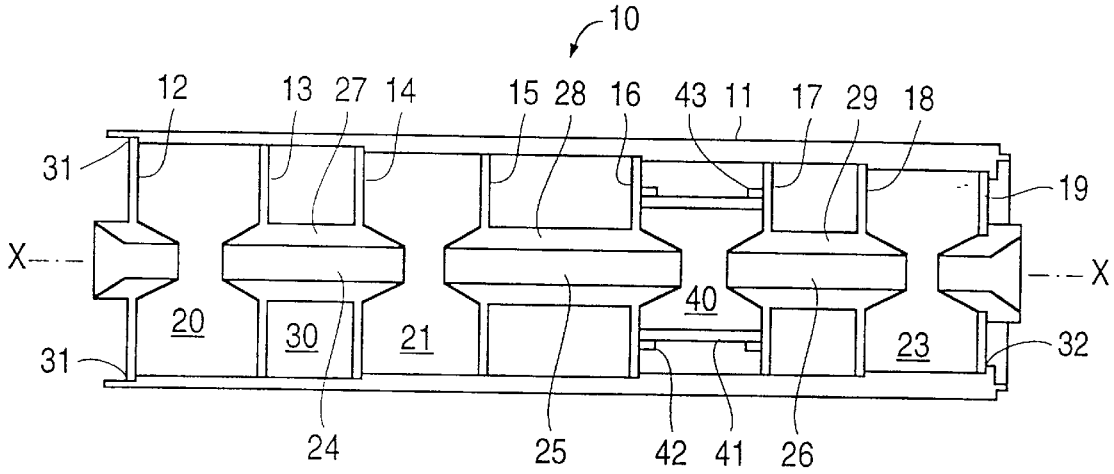
FIG. 4 schematically illustrates another resonant cavity structure.

With reference to FIG. 4, a resonant cavity structure for use in a tube in accordance with the invention is similar to that shown in FIG. 2 but includes a second harmonic resonant cavity 40 in place of one of the larger cavities. The outer surface of the cavity 40 is defined by a cylindrical wall 41 located on annular flanges 42 and 43 on the transverse wall 16 and 17.

We claim:

1. A klystron comprising:

an electron gun for generating an electron beam;

a gas-tight envelope comprising a unitary cylindrical member having an inner surface, an outer surface, and a longitudinal axis, said inner surface having a diameter, said diameter decreasing stepwise along said longitudinal axis;

first and second walls positioned transverse to said longitudinal axis and affixed to said inner surface, said first wall being spaced apart from said second wall, said first and second walls and said inner surface defining an output resonant cavity therebetween, wherein the diameter of said inner surface comprises a step, said first wall being located adjacent to said step, said electron beam passing through said output resonant cavity;

a drift tube extending in a direction parallel to said longitudinal axis, said drift tube being affixed to said first wall, said drift tube defining a drift space, said electron beam passing through said drift space;

third and fourth walls positioned transverse to said longitudinal axis and affixed to said inner surface, said fourth wall being spaced between said third and first walls, said third and fourth walls and said inner surface defining an input resonant cavity therebetween, said electron beam passing through said input resonant cavity;

means for applying a high frequency signal to be amplified to said input resonant cavity;

means for extracting an amplified high frequency signal from said output resonant cavity; and collector means for receiving said electron beam, said collector means coupled to said output resonant cavity.

2. An electron beam tube comprising:

a gas-tight envelope comprising a unitary cylindrical member having an inner surface, an outer surface, and a longitudinal axis, said inner surface having a diameter, said diameter decreasing stepwise along said longitudinal axis;

first and second walls positioned transverse to said longitudinal axis and affixed to said inner surface, said first wall being spaced apart from said second wall, said first and second walls and said inner surface defining a resonant cavity therebetween, wherein the diameter of said inner surface comprises a step said first wall being located adjacent to said step; and a drift tube extending in a direction parallel to said longitudinal axis, said drift tube being affixed to said first wall, said drift tube defining a drift space.

3. A tube as claimed in claim 2 further comprising:

a third wall positioned transverse to said longitudinal axis and affixed to said inner surface and said drift tube, said first wall being spaced between said second and third walls, said first and third walls and said drift tube defining a drift space therebetween.

4. A tube as claimed in claim 2 further comprising permanent magnetic focusing means surrounding said outer surface of said unitary cylindrical member.

5. A tube as claimed in claim 2 further comprising:

third and fourth walls positioned transverse to said longitudinal axis and affixed to said inner surface, said third wall being spaced between said first and fourth walls; and a cylindrical wall extending in a direction parallel to said longitudinal axis, said cylindrical wall being affixed to said first and fourth walls, said cylindrical wall being spaced from said inner surface, said first and fourth walls and said cylindrical wall defining a second resonant cavity therebetween.

6. A tube as claimed in claim 5 wherein said second resonant cavity has a frequency which is a harmonic of a frequency associated with said resonant cavity.

7. A tube as claimed in claim 5 wherein said second resonant cavity is a second harmonic resonant cavity.

8. A tube as claimed in claim 5 wherein said resonant cavity has a first frequency, said second resonant cavity has a second frequency, said second frequency being higher than said first frequency.

9. A tube as claimed in claim 2 wherein said unitary cylindrical member is wholly of metal.

10. A tube as claimed in claim 2 wherein said first and second walls are positioned normal to the longitudinal axis of said unitary cylindrical member.

11. A tube as claimed in claim 2 further comprising means for flowing a coolant fluid over said outer surface of said unitary cylindrical member.

12. A tube as claimed in claim 2 further comprising electromagnetic coil means surrounding said outer surface of said unitary cylindrical member.

13. A tube as claimed in claim 12 further comprising a frame affixed to said outer surface, wherein said electromagnetic coil means is wound on said frame.

14. An electron beam tube comprising:

a gas-tight envelope comprising a unitary cylindrical member having an inner surface, an outer surface, and a longitudinal axis, said inner surface having a diameter, said diameter decreasing stepwise along said longitudinal axis;

first and second walls positioned transverse to said longitudinal axis and affixed to said inner surface, said first wall being spaced apart from said second wall, said first and second walls and said inner surface defining a resonant cavity therebetween, wherein the diameter of said inner surface comprises a step, said first wall being located adjacent to said step;

a drift tube extending in a direction parallel to said longitudinal axis, said drift tube being affixed to said first wall, said drift tube defining a drift space; and an electromagnetic coil surrounding said unitary cylindrical member, said electromagnetic coil being capable of being removed from said unitary cylindrical member without damage thereto.

15. A tube as claimed in claim 14 further comprising a frame affixed to said outer surface, wherein said electromagnetic coil is wound on said frame.

16. A tube as claimed in claim 14 wherein said electromagnetic coil is wound on the outer surface of said unitary cylindrical member.

* * * * *